United States Patent [19]

Guzik

[11] 4,316,585

[45] Feb. 23, 1982

[54] GYRATORY CRUSHER

[75] Inventor: Didier Guzik, Denain, France

[73] Assignee: Fives-Cail Babcock, Paris, France

[21] Appl. No.: 130,864

[22] Filed: Mar. 17, 1980

[30] Foreign Application Priority Data

Mar. 26, 1979 [FR] France ..... 79 07493

[51] Int. Cl.[3] ..... B02C 2/06

[52] U.S. Cl. ..... 241/211; 241/37

[58] Field of Search ..... 241/37, 207–216

[56] References Cited

U.S. PATENT DOCUMENTS

| | | | |
|---|---|---|---|
| 3,328,888 | 7/1967 | Gieschen et al. | 241/37 |
| 4,179,076 | 12/1979 | Barrot et al. | 241/207 |
| 4,232,833 | 11/1980 | Werginz | 241/37 |
| 4,251,035 | 2/1981 | Chatwin et al. | 241/37 |

FOREIGN PATENT DOCUMENTS

| | | | |
|---|---|---|---|
| 1254943 | 11/1967 | Fed. Rep. of Germany | 241/211 |
| 1507568 | 7/1969 | Fed. Rep. of Germany . | |
| 2357432 | 5/1975 | Fed. Rep. of Germany | 241/37 |

*Primary Examiner*—Howard N. Goldberg
*Attorney, Agent, or Firm*—Kurt Kelman

[57] ABSTRACT

The invention relates to a gyratory crusher having a breaking head resting on the piston of a hydraulic adjustment ram. This crusher is characterized in that the piston of the ram carries a rack arranged parallel to its axis and a pinion meshing with this rack is fixed to the end of a shaft going through the wall of the ram cylinder, the other end of this shaft being coupled to a sensor delivering an electric signal according to the angular position of the shaft. The invention is applicable to gyratory or cone crushers or breakers.

5 Claims, 3 Drawing Figures

GYRATORY CRUSHER

This invention relates to gyratory crushers or breakers having a conical breaking head mounted inside a ring having a general truncated-cone shape, this head being driven by a suitable mechanism so that its axis describes a cone with a fixed apex located on the axis of the ring, the breaking head resting on the piston of a hydraulic ram whose position determines the size of the discharge opening.

More particularly, the invention relates to machines of this type equipped with a device indicating the position of the breaking head. Different devices have been devised or proposed for indicating the position of the breaking head and allowing its remote adjustment. Generally, they include a rod integral with the piston and going through the bottom of the cylinder of the ram, and means such as a potentiometer, a variable inductance coil or variable capacitance capacitor linked functionally with the rod to transform its movements into variations in voltage or in electric current. The crossing of the bottom of the cylinder by the rod raises sealing problems difficult to solve in view of the high pressure of the oil in the cylinder.

Another solution consists in using a rod going radially through the wall of the cylinder and whose end is kept in contact with a truncated cone surface of the piston. The vertical movements of the piston cause the moverment of the rod whose position is detected by conventional means. The drawback of this solution is that it requires the machining of a truncated cone surface on the piston.

It is the object of the invention to remedy the drawbacks of known techniques and to provide a cone position indication device of simple and rugged construction.

The gyratory crusher of this invention is characterized in that the piston carries a rack arranged parallel to its axis and a pinion meshing with this rack is attached to the end of a shaft going through the wall of the ram, the other end of this shaft being coupled to a sensor delivering an electric signal according to the angular position of the shaft.

According to a preferred embodiment of the invention, the rack is fitted into a longitudinal groove formed on the outer surface of the piston and isolated from the inside of the cylinder by the seal of the piston. Thanks to this arrangement, the pressure in the groove is much lower than in the cylinder, thereby simplifying sealing problems raised by the crossing of the wall of the cylinder by the shaft of the pinion. The rack can in particular be arranged on one side of the groove, the piston having a diameter smaller than the width of the groove and fitting inside the groove.

The pinion shaft is advantageously mounted on an inserted piece fixed in a bore drilled in the wall of the cylinder, this insert being equipped with a head fitting into the groove of the piston and whose role is to prevent the rotation of the piston and to limit its upward movement. This inserted piece can moreover include an oil channel leading into the groove of the piston to allow the lubrication of the rack/pinion assembly and then, thanks to channels leading to the groove, the lubrication of the stop piece mounted on the head of the piston.

Other characteristics of the invention will appear from the following description with reference to the accompanying drawings showing a nonlimitative example of an embodiment of the invention and in which.

Figure 1:
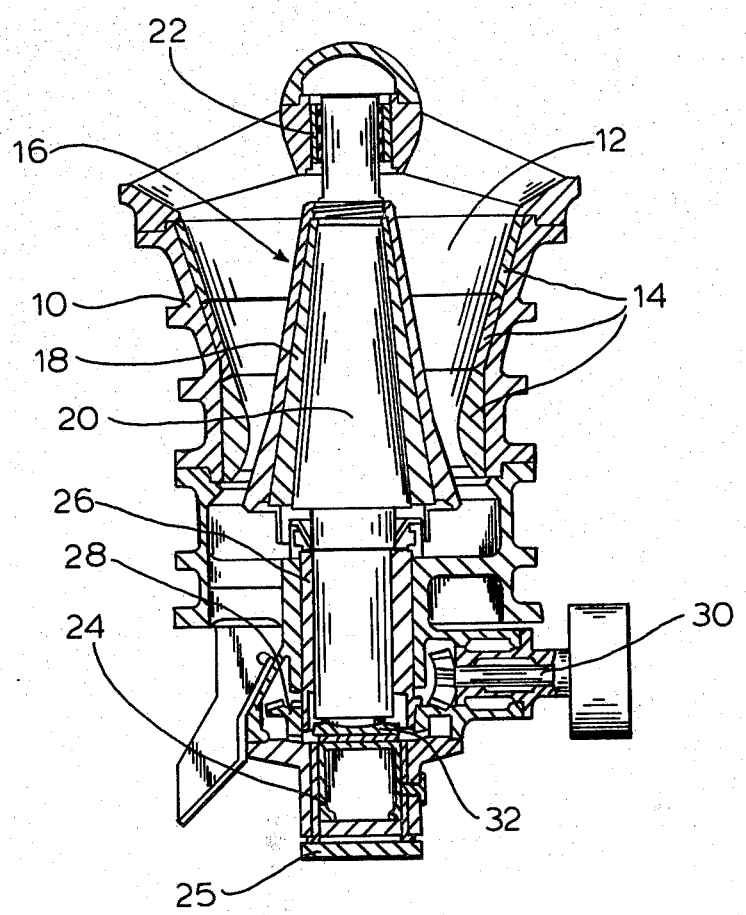
FIG. 1 is a sectional view through a vertical plane of a gyratory crusher according to the invention.

The crusher shown in FIG. 1 includes a frame 10 whose top part, of general truncated shape, delimits a crushing chamber 12. The wall of this chamber is lined with wearing parts 14.

A breaking head 16 is mounted in the chamber 12. It is made up of a cone 18 fitted on a shaft 20 whose upper end is held in a bearing 22 carried by arms fixed to the frame and whose lower end rests on the piston 24 of a hydraulic ram 25 fixed under the frame. This ram makes it possible to adjust the height of the breaking head 16 and, consequently, the size of the discharge opening at the bottom of the chamber 12 between the breaking head and the wall of the chamber.

The bottom of the shaft turns in the eccentric bore of a sleeve 26 mounted in a bearing of the frame arranged coaxially with respect to the crushing chamber. A ring gear 28 integral with the sleeve and meshing with a pinion fixed to the end of a shaft 30 equipped with a pulley makes it possible to impart rotation to the sleeve.

When the sleeve is rotated, the axis of the breaking head describes a cone whose apex is located on the axis of the crushing chamber at the level of the top bearing 22. This bearing is designed to allow this movement. For the same purpose, the bottom of the shaft 20 has a spherical surface resting on the top surface, of complementary form, of a stop piece 32 whose flat bottom surface can slide on the head of the piston 24.

Figure 2:
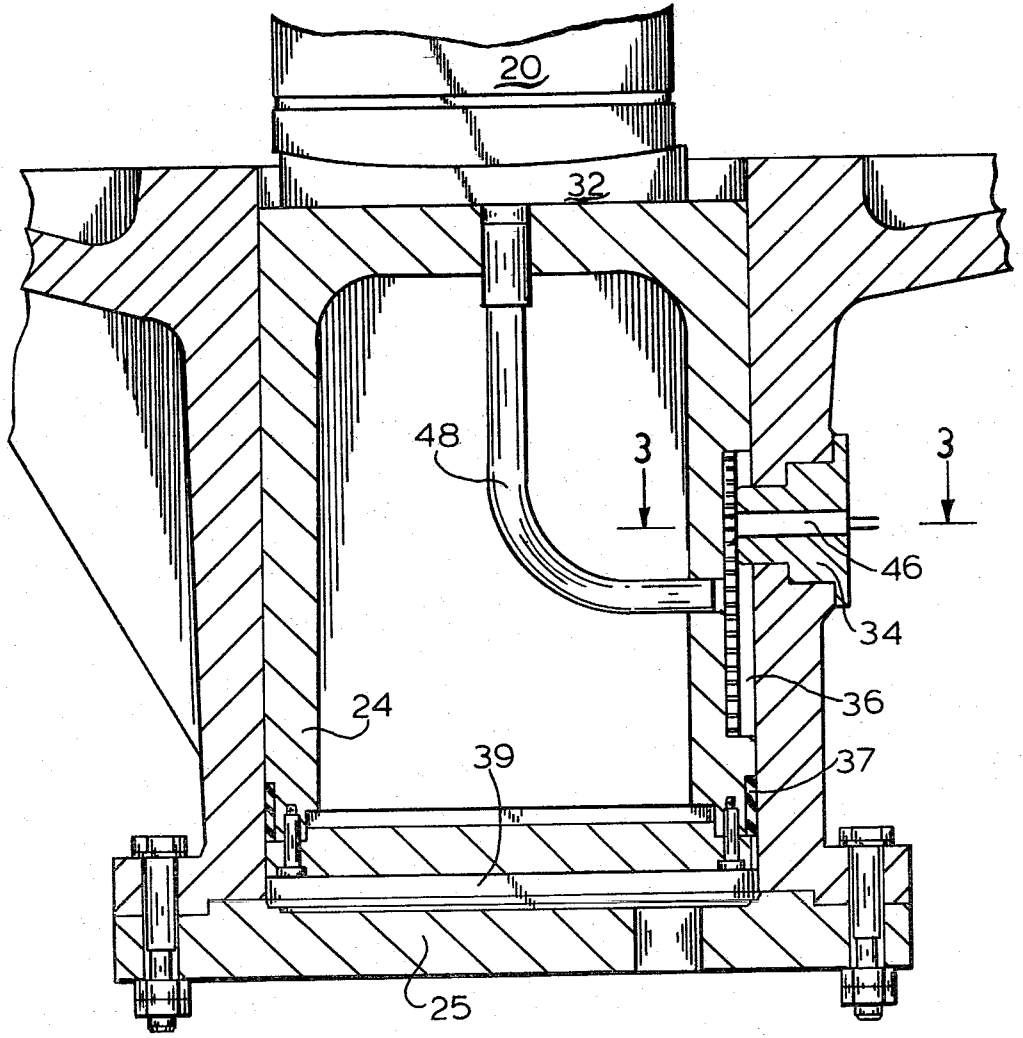
FIG. 2 is a larger-scale view of the lower part of the crusher of FIG. 1.
Figure 3:
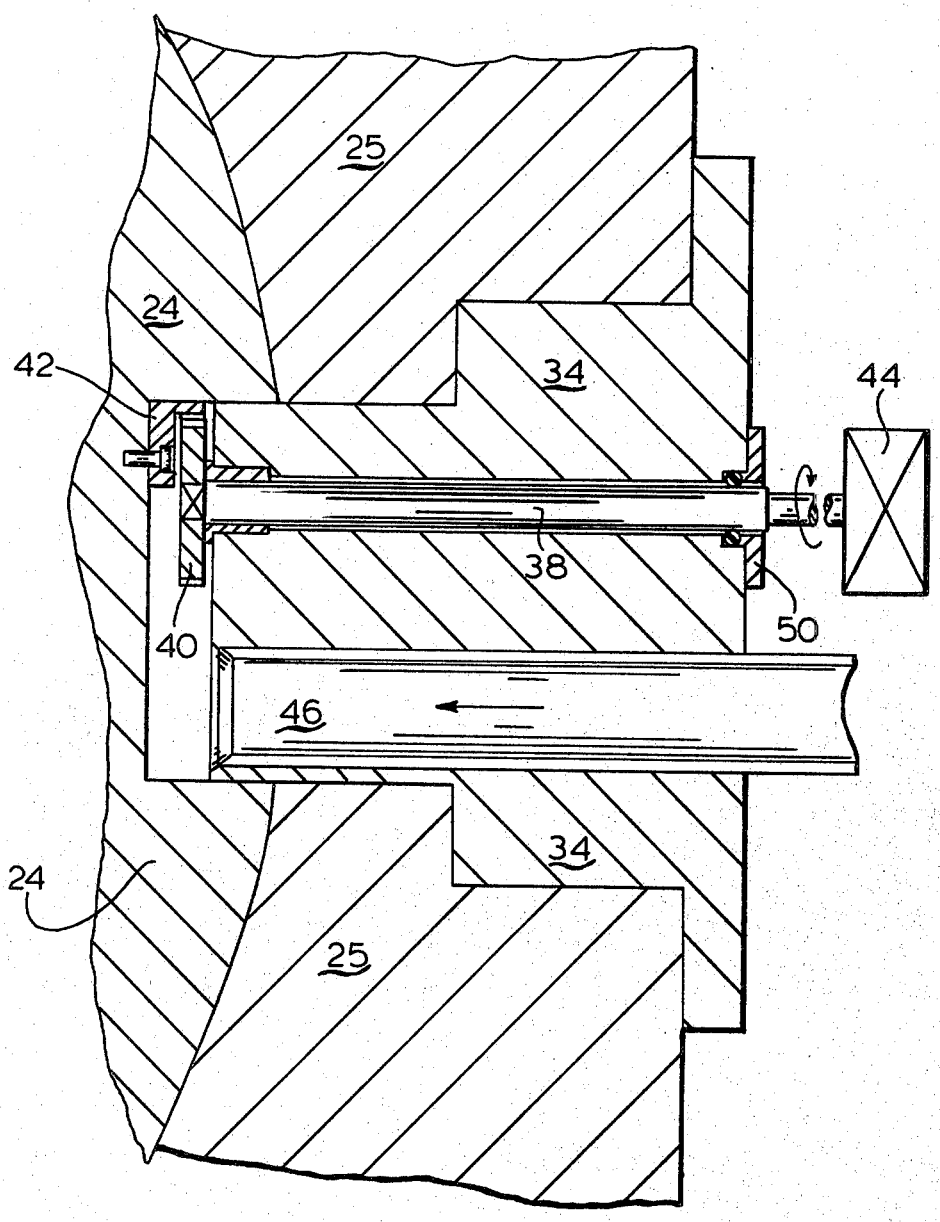
FIG. 3 is a section along the line 3—3 of FIG. 2 represented in a larger scale.

A piece 34 going through the wall of the ram cylinder and whose head penetrates into a longitudinal groove 36 of the piston (FIGS. 2 and 3) prevents the rotation of the piston and limits its axial movements. The head of the piece 34 has a square section and its flanks are in contact with the flanks of the groove. The seal 37 of the piston isolates the groove 36 from the chamber 39 of the ram in which a high pressure prevails.

On the piece 34 is mounted a shaft 38 the bottom end of which carries a pinion 40 meshing with a rack 42 arranged on one side of the groove and fixed on the piston by screws. The other end of the shaft 38 is coupled to a sensor 44, such as a potentiometer, which delivers an electric signal according to the angular position of the shaft. An examination of this signal thus makes it possible to determine at a distance the height of the piston and, consequently, of the breaking head and to check the adjustment of the discharge opening.

The piece 34 is traversed by a channel 46 which allows oil to be brought into the groove to lubricate the pinion/rack mechanism. From the groove 36, the oil is brought through a tube 48 to the sliding surfaces of the stop 32 for lubrication.

A seal 50 is provided on the shaft 38.

Numerous modifications can be made to the embodiment described above by the use of equivalent technical means, and it is understood that all these modifications fall within the framework of the invention.

What we claim is:

1. A gyratory crusher comprising a breaking head, a hydraulic ram having a cylinder and a piston, the breaking head resting on said piston, a rack fitted in a longitudinal groove formed on the outer surface of the piston, a pinion meshing with the rack and fixed to one end of a shaft going through a wall of the ram cylinder and a sensor coupled to the other end of said shaft, said sensor delivering an electric signal according to the position of the shaft.

2. A gyratory crusher according to claim 1, wherein the longitudinal groove formed on the piston is isolated from a pressure chamber of the ram by a piston seal.

3. A gyratory crusher according to claim 1 or 2, wherein said rack is arranged on one side of the groove and said pinion has a diameter smaller than the width of the groove and is located into said groove.

4. A gyratory crusher according to claim 3, wherein said shaft is mounted in a piece going through the wall of the ram cylinder and said piece is equipped with a head penetrating into said groove of the piston to prevent the rotation of the piston and to limit its axial movements.

5. A gyratory crusher according to claim 4, wherein said piece has an oil channel leading into said groove and said piston has an oil channel leading from said groove to bearing surfaces provided on the piston and breaking head.

* * * * *